US007571670B2

(12) United States Patent
Formon

(10) Patent No.: US 7,571,670 B2
(45) Date of Patent: Aug. 11, 2009

(54) ADJUSTABLE CUTTER

(75) Inventor: John S. Formon, Appleton, WI (US)

(73) Assignee: SCA Tissue North America LLC, Neenah, WI (US)

( * ) Notice: Subject to any disclaimer, the term of this patent is extended or adjusted under 35 U.S.C. 154(b) by 248 days.

(21) Appl. No.: 11/546,255

(22) Filed: Oct. 12, 2006

(65) Prior Publication Data

US 2007/0089582 A1 Apr. 26, 2007

Related U.S. Application Data

(63) Continuation-in-part of application No. 10/812,183, filed on Mar. 30, 2004, now abandoned.

(51) Int. Cl.
*B26D 7/00* (2006.01)

(52) U.S. Cl. ..... 83/648; 83/649; 83/337; 225/96

(58) Field of Classification Search ..... 83/337, 83/644, 648–650, 298, 191, 836, 839; 225/96, 225/93, 15

See application file for complete search history.

(56) References Cited

U.S. PATENT DOCUMENTS

| | | | | |
|---|---|---|---|---|
| 3,575,328 | A | 4/1971 | Bump | |
| 3,686,988 | A | 8/1972 | Ross | |
| 3,762,264 | A | 10/1973 | Scott | |
| 4,122,738 | A | 10/1978 | Granger | |
| 4,621,755 | A | 11/1986 | Granger | |
| 4,635,837 | A | 1/1987 | Granger | |
| 5,009,140 | A | 4/1991 | Nolan et al. | |
| 5,441,189 | A | 8/1995 | Formon | |
| 6,363,824 | B1 * | 4/2002 | Granger | 83/334 |
| 6,609,449 | B2 * | 8/2003 | Granger | 83/649 |
| 6,684,751 | B2 * | 2/2004 | Kapiloff et al. | 83/649 |

* cited by examiner

*Primary Examiner*—Boyer D Ashley
*Assistant Examiner*—Omar Flores-Sánchez
(74) *Attorney, Agent, or Firm*—Young & Thompson

(57) ABSTRACT

A paper towel dispensing apparatus, includes a housing having a cover, a drum, an associated cutting device incorporated in the drum, and a stored energy mechanism. The cutting device having plural blades that are spaced apart from each other. A space between blades is adjustable so that tails of differing sizes can be obtained when the paper towels are dispensed. Accordingly, different tensile strength towels can be used with the same dispenser.

8 Claims, 5 Drawing Sheets

ADJUSTABLE CUTTER

FIELD OF THE INVENTION

The invention relates to flexible sheet material dispensers, such as dispensers for paper towels. Preferred embodiments in the invention more particularly relates to a apparatus for cutting and dispensing individual sheets of creped paper toweling.

BACKGROUND OF THE INVENTION

Dispensers for continuous, unperforated flexible sheet material, such as paper toweling, include those in which the sheets are simply torn from the web by the user or, more commonly, those in which the sheets are completely severed by a cutter in the dispenser for removal by a user. Also known are dispensers in which the cutter in the dispenser produces a line of cuts including residual segments of uncut material in the web defining the desired sheet that is, thereafter, completely severed by the user upon removal.

Dispensers of more recent design utilize cutting devices in the dispenser that cut the web material to sheet length as the user pulls it from the dispenser. Such apparatus typically involve a feed roll from which paper is supplied by a user grasping the free end of the web that is disposed outside the dispenser chassis and pulling it to operate the feed roll. In these devices a stored energy mechanism, such as a spring, may be associated with the feed roll to activate the cutter and/or to conduct the web material from the dispenser. As mentioned, cutters for such dispensers may cut the material to totally sever a sheet from the web or, alternatively, may produce such a cut as will only partially sever the web, leaving the sheet connected to the web by means of one or more unsevered segments of residual web material, for removal by the user following conduct of the sheet from the dispenser by the feed roll.

Dispensers of the concerned type in which a cutter operates in conjunction with a feed roll and in which the motive force for the operation of the dispenser is provided by the web material being pulled by the user are exemplified by U.S. Pat. Nos. 3,575,328; 4,122,738; 4,621,755 and 5,441,189. These dispensers each characteristically employ an over-center spring drive that is loaded during a first portion of the operating cycle of the mechanism during which cutting is normally effected as the web material, in friction contact with the feed roll, is pulled from the dispenser. After completion of the cutting operation, when the feed roll is rotated beyond the over-center condition, the spring is unloaded and the energy stored therein is utilized to drive the feed roll to conduct the cut web portion from the dispenser and to dispose the leading end of the succeeding length of web material at a location outside the dispenser chassis where it can be readily grasped by the next user.

In the mechanism described in U.S. Pat. Nos. 3,575,328 and 5,441,189, the cutting knife produces a perforated, or only partially severed, line of cut. It has been determined that the unsevered segments or tabs of residual web material depend on the tensile strength of the material. The type of material, the thickness of the material and many other different factors known in the art determine the tensile strength of the material. Accordingly, when the sheet defined by the perforated line of cut is caused to be completely severed by the pulling force imparted by the user, in the case of low tensile strength products this pulling force will be less than the pulling force required for a high tensile strength product.

It has been determined that users pull with a fairly constant pulling force. Therefore, for a given dispenser, products that have a low tensile strength will have a tendency to break early such that the force required to overcome the spring force is insufficient. For the same dispenser, products that have a high tensile strength can cause multiple towel dispensing, because the force exerted would be insufficient to separate the tabs during dispensing. Accordingly, manufacturers are forced to design dispensers that are matched to the tensile strength of the product to be dispensed.

While adjustable cutter are known per se, these cutters are directed to various aspects of the art that are not pertinent to the present invention. Specifically, U.S. Pat. No. 5,975,456 describes an adjustable web cutter, which allows webs to be cut in various lengths, widths and thickness. The blade adjustment mechanism allows a depth of the blade to be adjusted. U.S. Pat. No. 5,868,346 describes an apparatus for severing a web having a cutter bar with a cutter blade that is adjustable relative to core tubes. U.S. Pat. No. 4,846,035 describes an apparatus for cutting bands of wound material. There are two independent blades that are arranged side by side at an angle to each other and have a hinging movement. The cut is made in two stages and leaves a rectilinear cutting line. U.S. Pat. No. 4,316,564 shows a dispenser for sheet material wound on a roll. A distance between walls of the dispenser is adjustable.

Accordingly, there is a need for an adjustable cutter that can be used in a dispenser where the web material is pulled by the user so that various webs of differing tensile strength can be cut using the same dispenser. The present invention seeks to address this need.

SUMMARY OF THE INVENTION

An object of the present invention is to provide an improved dispenser for flexible sheet material.

Another object of the present invention is to provide an improved apparatus for dispensing sheets obtained from an elongated web of flexible material by the operation of a cutter and dispensed by withdrawal therefrom by the user.

Yet another object of the present invention is to provide an improved apparatus for dispensing partially severed sheets of predetermined length from an elongated web of material in which, in withdrawing the material from the dispenser, the user effects complete severance of the sheet from the web and automatically delivers the free end of the succeeding material to a position for grasping by the next user.

Still another object of the present invention is to provide an improved dispenser for soft, absorbent paper toweling capable of producing the desired results and which can dispense a plurality of different tensile strength products from the same dispenser.

Directed to achieving the desired results is a dispenser for flexible sheet material comprising a chassis forming a housing having a material discharge opening, a flexible sheet material feed, a longitudinally adjustable cutting device for cutting the web to produce therein a transverse line of cut containing at least one residual unsevered segment of web material for maintaining the continuity of the web, a feed roll mounted on the chassis for rotation through an operating cycle in which the web is conducted from the material feed into operative relation to the cutting device, and thence to a predetermined position outside the discharge opening to be grasped by a user for pulling the web from the dispenser to thereby impart rotational movement to the feed roll, and an energy storing device operatively connected to the feed roll to be loaded during rotation of the feed roll through one portion of the operating cycle and unloaded during another portion of the operating cycle for moving the feed roll to conduct the sheet material web, with the line of cut thereon, exteriorly of the discharge opening, the energy storing device imparting a resistive force to the feed roll effective to operate against the pull of the user to impart a gradually increasing force on the web for severing the residual segments.

These and other aspects of the invention and their advantages will become more apparent by reference to the following detailed description of the invention in conjunction with the appended drawings.

DETAILED DESCRIPTION OF THE PREFERRED EMBODIMENT

Figure 1:
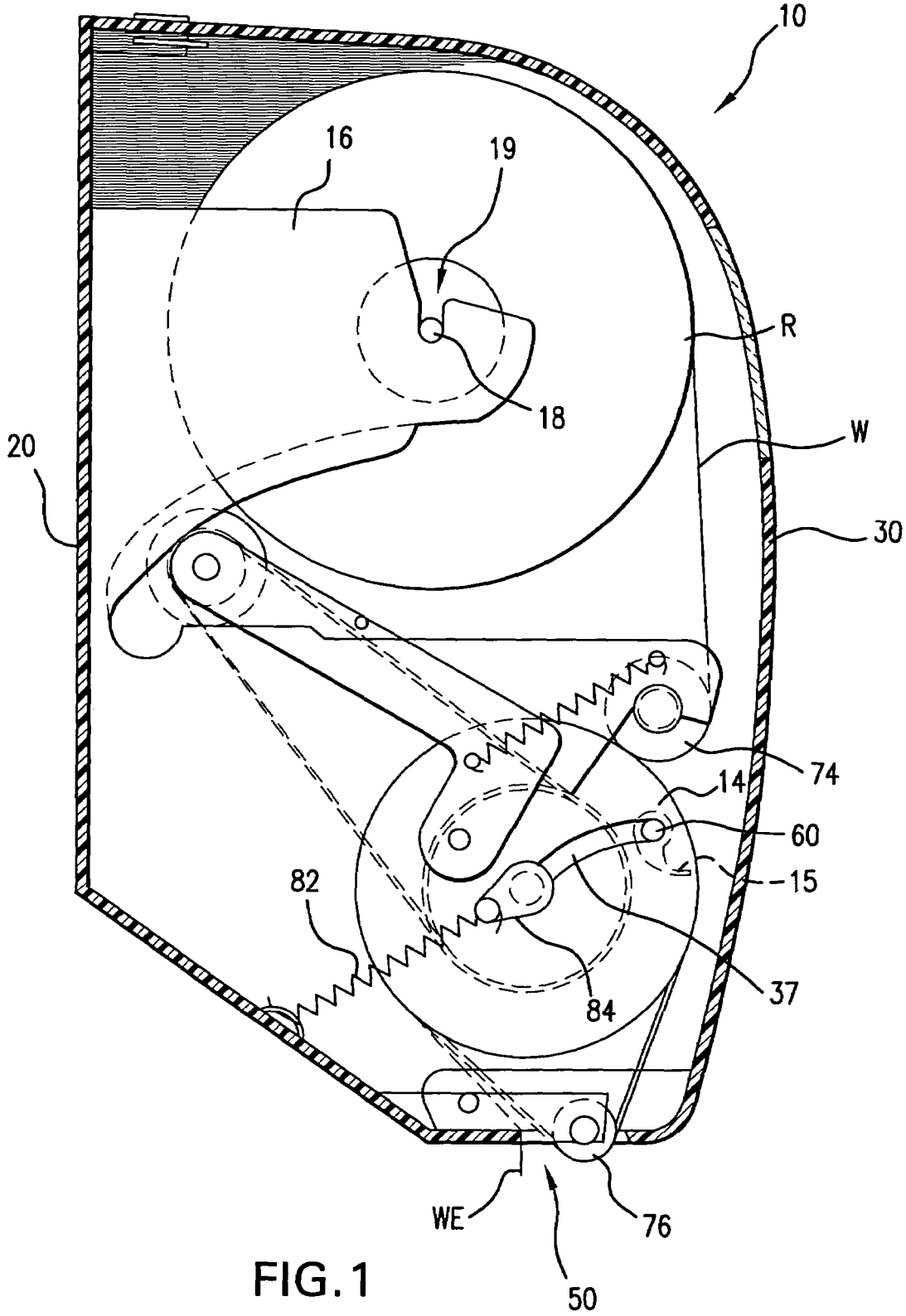
FIG. 1 is a somewhat diagrammatic side elevational view, with portions thereof in section, of a web material dispenser according to the present invention.

FIG. 1 diagrammatically illustrates a dispenser 10 for practicing the invention. The dispenser 10 comprises a cabinet chassis including a back plate 20 provided with means (not shown) to permit attachment to an upstanding wall, or the like and a cover 30. Inside the cover 30 is a feed roll 14. A cutting device 15 is incorporated in the feed roll 14. A bracket 16, attached to the plate 20, mounts a supply roll R of flexible sheet web material, such as paper toweling. Each arm of the bracket 16 detachably supports at its free end a reel holder 19 adapted to be inserted into an end of the core of the supply roll R, such that the roll can readily rotate about a protrusion 18 extending from the reel holder 19. Alternatively, the bracket may have one arm that has a projecting portion (not shown) that fits into the end of the core and one reel holder 19 with a protrusion 18.

In addition, there are various braking and tensioning devices as is known in the art that are part of the dispenser 10, but are not described herein, since the present invention is most concerned with the cutting device 15. Accordingly, the description of the dispenser 10 is described with respect to the interrelationship between the cutting device 15 and the dispenser 10 so that one of ordinary skill in the art could fully appreciate the invention. However, those of ordinary skill in the art would appreciate that the cutting mechanism as described in further detail below could be modified for various different types of dispensers.

Figure 2:
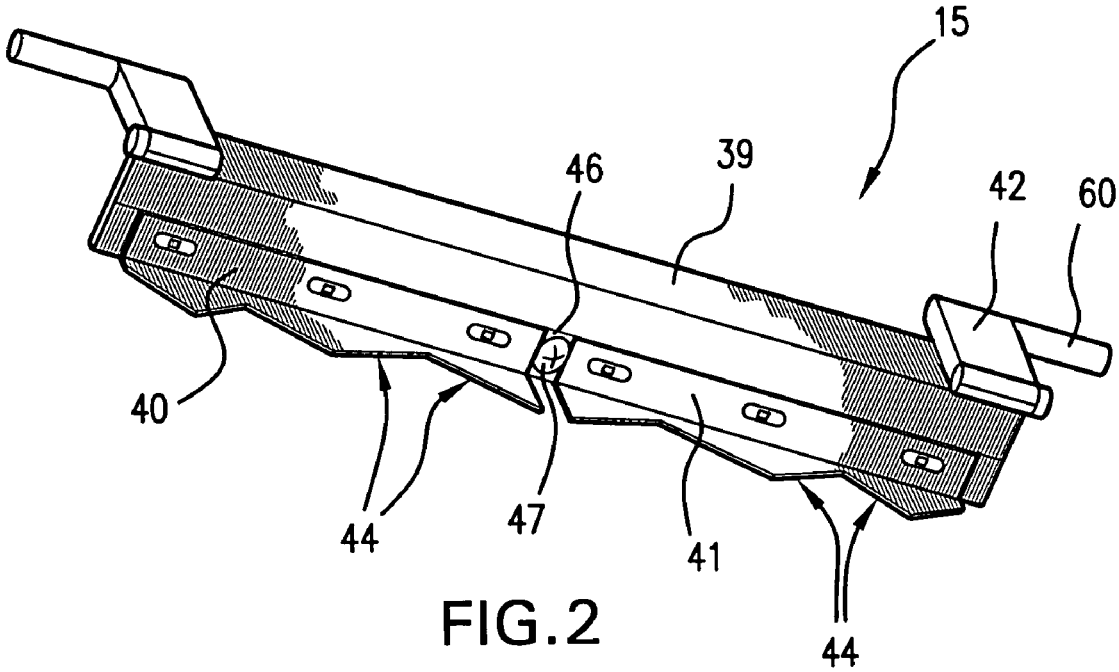
FIG. 2 is an elevational view of a cutting blade utilized in the practice of the invention.

In the embodiment shown in FIG. 2, the cutting mechanism 15 comprises a carrier structure 39 for a pair of adjacent cutting blades 40, 41 and includes a pair of oppositely spaced plates 42. The plates 42 are each fixedly mounted on each end of the carrier structure 39. The blades 40, 41 are each formed with a plurality of teeth 44 longitudinally spaced along the lengths thereof. In the illustrated embodiment, three teeth 44 are provided along the length of each blade 40, 41. A recess 46 separates the pair of blades 40, 41 from each other.

The distance between the blades 40, 41 is adjustable such that the size of recess 46 is made larger or smaller depending on the desired tab size to remain when a sheet is dispensed. The size of the recess may be adjusted using eccentric element 47. Eccentric element 47 is shaped to have a thin portion and a wide portion. When the eccentric element 47 is positioned at the thin portion, a small tab would result when the web is dispensed, and similarly, when the eccentric element 47 is positioned at the wide portion, a relatively wider tab would be dispensed. A maintenance person may manually adjust the eccentric element 47 by rotating the eccentric element 47 with a screwdriver or like tool. By adjusting the eccentric element, tabs of different widths may be obtained. Accordingly, webs of varying tensile strength can be used in the same dispenser without the problem of there being too small a tab that will break early leading to a no towel showing scenario, or too large a tab that will not break so that multiple towels are dispensed.

Figure 7:
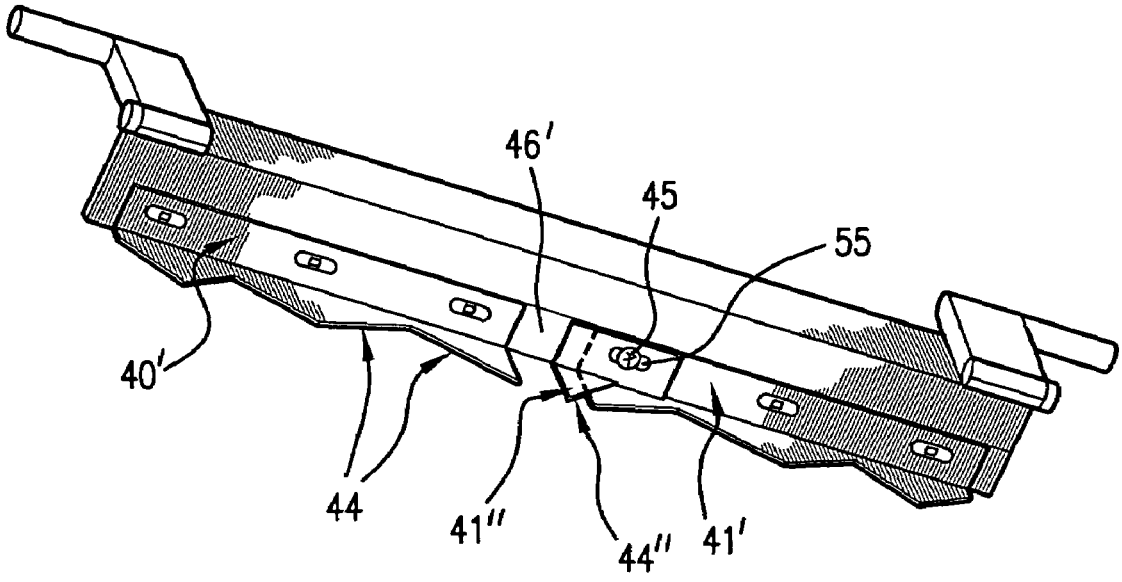
FIG. 7 is an elevational view of a cutting blade according to an embodiment of the invention.

In a presently preferred embodiment as seen in FIG. 7, the adjustment may be simplified by adjusting only one blade. In this embodiment, there are three blades 40', 41' and 41". Blades 40' and 41' are preferably fixed with only blade 41" being adjustable. In the presently preferred embodiment of FIG. 7, blade 41" has a single tooth 44". Tooth 44" is slidable along blade 41' and may be in direct contact therewith to act substantially as an extension of blade 41'. The adjustment is made by loosening a screw 45 holding blade 41" to blade 41'. When the screw 45 is loosened part way, the blade 41" is slidable in a longitudinal direction in closed-end slot 55 to increase or decrease the size of recess 46'. Although FIG. 7 shows a single tooth 44", of course, two or more teeth may be used. In addition, although FIG. 7 shows the third adjustable blade 41" connected to blade 41', nevertheless, blade 41" could instead be connected to blade 40' Further, two small adjustable blades could be used with respect to each of blades 40', 41' instead of the one adjustable blade 41".

In the embodiments shown in FIGS. 2 and 7, there will be a single central tab remaining when the sheet is dispensed. However, the invention is not limited to the single central tab. Specifically, it is contemplated that there may be three or more adjustable blades such that there would be two or more tabs. In addition, the tabs are not limited to the central portion of the web. There may be tabs at edge portions or any intermediate portion of the web in addition to or instead of at the central portion.

Also in the embodiment shown in FIG. 2, there is a single eccentric element. However, there may be more than one element or the blades may be connected together by a lever or other adjustment device such that moving the lever from side to side will adjust the size of the recess.

Figure 3:
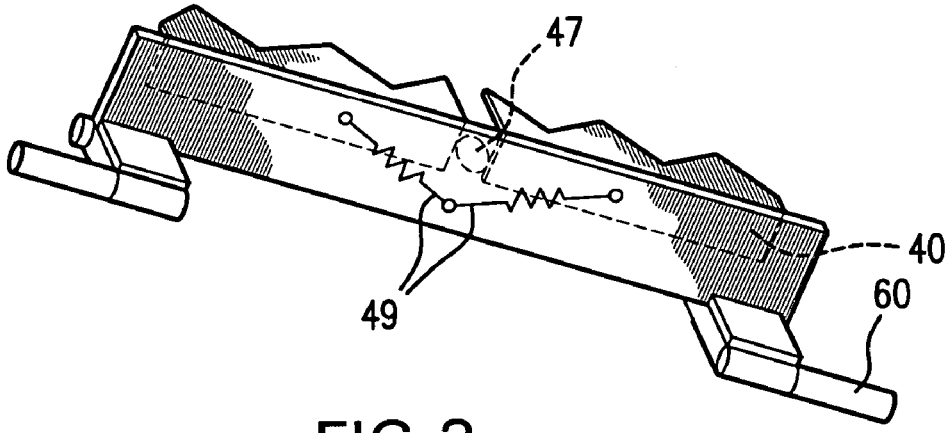
FIG. 3 is an elevational view of the rear of the cutting blade of FIG. 2.

As best seen in FIG. 3, the blades 40, 41 are continuously urged together by springs 49. Although springs 49 are shown, any resilient member would suffice. In addition, it is also contemplated that the back face of the eccentric element 47 could be rigidly attached to points on the backs of the blades 40, 41 such that rotation of the eccentric element 47 would move the blades without requiring a resilient member to urge the blades together.

Figure 4:
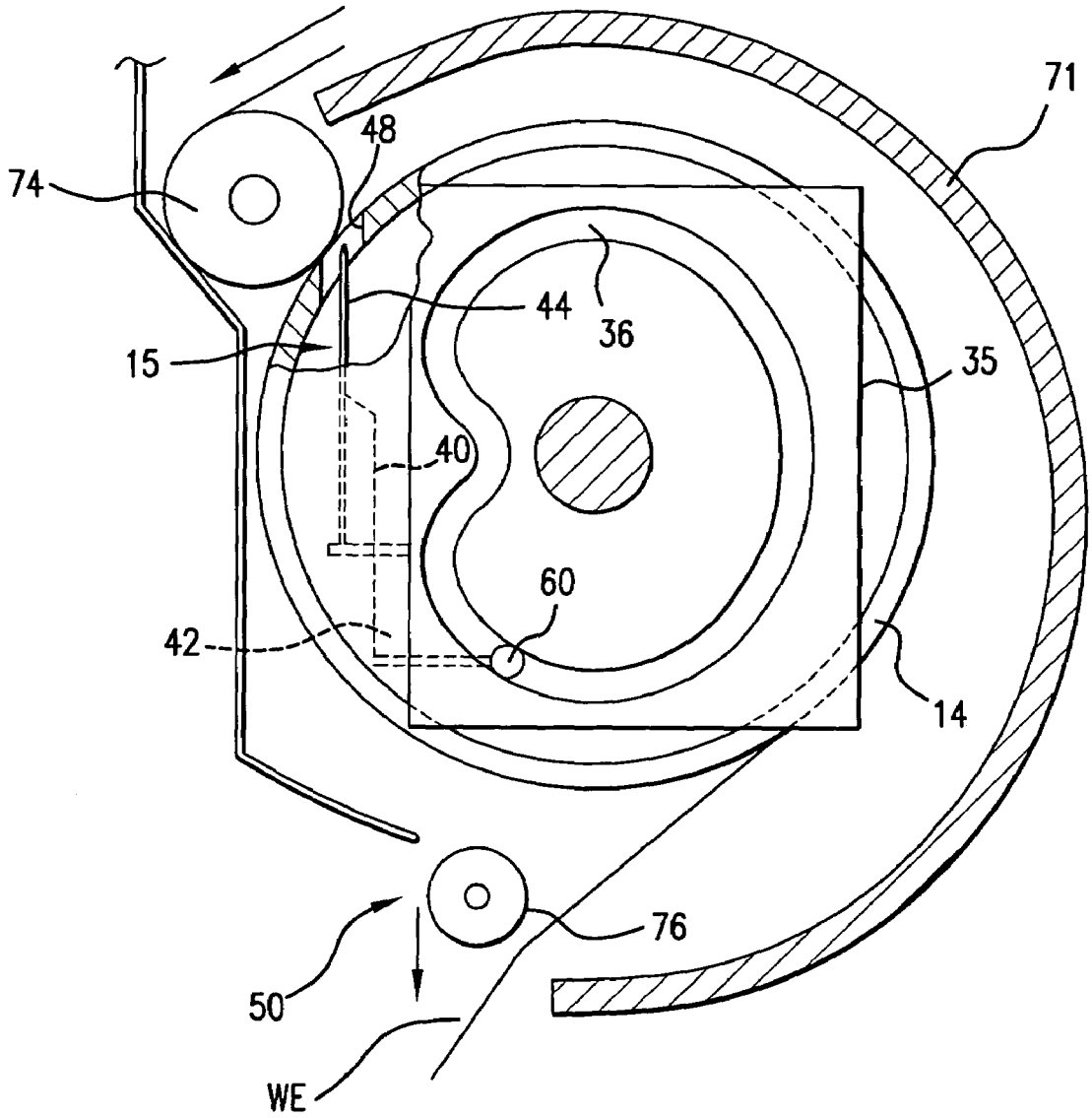
FIG. 4 is an enlarged sectional view of a dispenser of the invention.

As seen in FIG. 4, the cutting device 15 is housed within feed roll 14. The feed roll 14, on its external surface, is provided with an aperture defined by a longitudinal slot 48. The cutting blades 40, 41 are disposed within feed roll 14, with the respective teeth 44 on the blades 40, 41 adapted to project outwardly through the slot 48. Using this cutting blade design, the cut produced in the web of flexible sheet material as it passes over the surface of feed roll 14 is along a substantially straight line extending parallel to the axis of feed roll 14.

The line of cut produced by the illustrated blades 40, 41 contains one small uncut residual portion in the web which correspond essentially to the width of recess 46 between the blades.

By means of this small uncut portion, the continuity of the web is maintained, notwithstanding that it contains a substantial line of cut, while it traverses the mechanism within the dispenser chassis 10 before reaching the discharge opening 50. As is described in greater detail later, once that portion of the web containing the line of cut is conducted by the feed roll 14 through the opening 50 and thereafter subjected to a pulling force, the sheet defined by the line of cut is easily separated by the breaking of the uncut web portion produced by the configuration of the cutting blades 40, 41 and the cooperating slot 48 in the feed roll surface. The user thereby effectively obtains the appropriate length of toweling.

Figure 5:
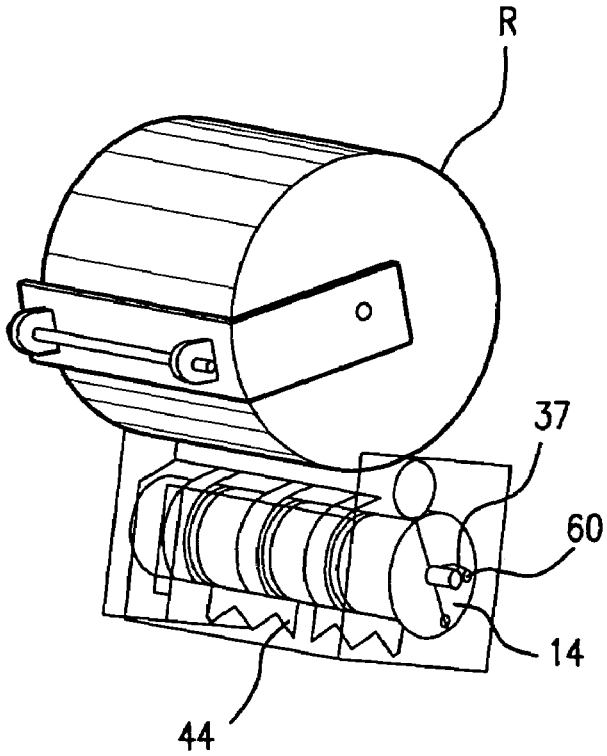
FIG. 5 is a view of the left side of the supply and feed roll arrangement with the cutting blade extended.
Figure 6:
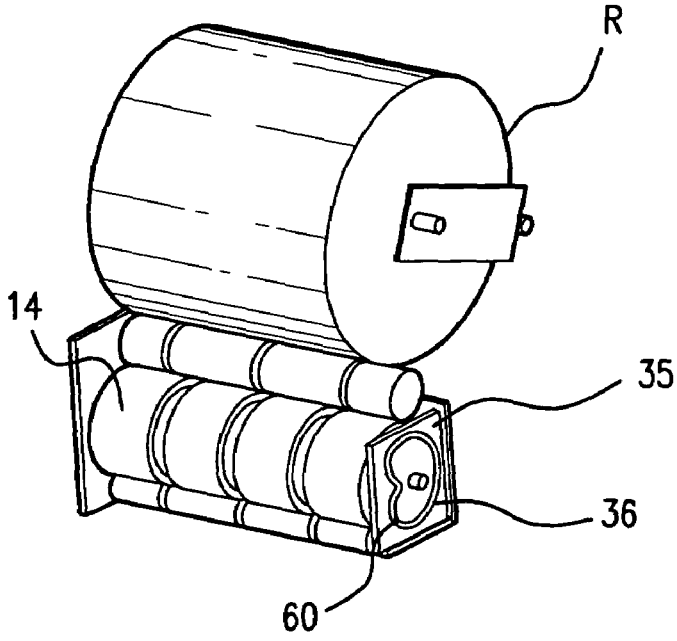
FIG. 6 is a view of the right side of the supply and feed roll arrangement with the cutting blade extended.

In a presently preferred embodiment, each of the carrier plates 42 attaching the opposite ends of the carrier structure 39 has a pair of guide pins 60 extending normally to the plane of the plate. These pins 60 are positioned on the respective plates 42 such that one pin 60 is guidingly received in groove 36 formed in guide block 35 adjacent at least one of the ends of the feed roller 14 as seen in FIGS. 4 and 6. The other pin 60 is received in slot 37 as seen in FIGS. 1 and 5. By means of this mounting arrangement, the cutting blades 40, 41 follow a path about the axis of the feed roll 14.

The path along which the web W of flexible sheet material moves from supply roll R through the dispensing and cutting mechanism will now be described with respect to the embodiment shown in FIG. 1. The embodiment shown in FIG. 1 is an exemplary embodiment and various other braking, tensioning and roller configurations as is known in the art could also be used.

After leaving roll R, the web W passes initially clockwise around the roll 74 which may be provided with a high friction surface. Web W then proceeds counterclockwise around the exterior of feed roll 14, which is provided with a high friction surface, formed, for example, of a resilient material or a roughened surface that has a sandpaper-like texture. A curved support element 71 is provided at a central portion of feed roll 14, and assists in threading the leading end of the web W around the rear side of the feed roll 14 within the dispenser chassis 10. Thereafter, the web W passes between roll 76 and the bottom of the dispenser 10 and exits through the discharge opening 50 placing its leading end WE in a position to be readily accessible externally of the dispenser 10 for an intending user of the toweling material.

Referring to FIGS. 5 and 6, the feed roll 14 is rotatably mounted on shafts extending axially outwardly from the opposite ends thereof. The outer end of one of the shafts may be provided with a hand wheel (not shown) fixedly secured thereto to enable manual rotation of the feed roll 14 when desired as, for example, for initially threading the web W of flexible sheet material from supply roll R through the dispensing and cutting mechanism to the discharge opening 50.

In order to remove web material from the dispenser it will be appreciated that a user will grasp the leading end WE of the web W and, in pulling it, cause the feed roll 14 to rotate thereby conducting the web along its intended path through the apparatus. Positive reciprocation of the cutting blades 40, 41, and thereby projection of the cutting teeth 44 beyond the periphery of the feed roll 14 to cut the web and thereafter to retract the knife as the feed roll rotates, is effected by the guide pins 60 at the respective upper ends of the carrier plate 42 for the cutting blades 40, 41 engaging the eccentric shaped groove 36. One particular configuration of the groove 36, which is effective to drive the cutting knife in the desired manner, is shown in FIGS. 4 and 6.

As the web material is pulled from the dispenser by the user, the web material frictionally engages the feed roll 14 causing it to rotate and the guide pin 60 to thus move counterclockwise, as shown in FIG. 4, around the path of groove 36. Continued rotational movement of the feed roll 14 moves the guide pin 60 from the lowermost position within groove 36 shown in FIG. 4 to the leftmost position. During this two hundred seventy degree rotation of feed roll 14, the teeth 44 on blades 40, 41 progress from within the interior of the feed roll to a position where the cutting edge defined by the teeth is fully projected, as shown in FIG. 5. Also, during this rotation of the feed roll 14, while the cutting edges of teeth 44 project through the aligned slot 48 in the feed roll surface, the web W is cut in a way that results in its not being completely severed but, instead, a small uncut portion defined by the recess 46 between blades 40, 41 remains along the line of cut.

Continued withdrawal of the web W by the user continues the rotation of the feed roll 14 thereby causing the guide pin 60 to move down within the groove 36 to retract the cutting edges of teeth 44 on cutting blades 40, 41 back within the feed roll. The blades 40, 41 retain this fully retracted position as the guide pin travels along the remaining path of groove 36 until the cycle is repeated.

According to an embodiment of the present invention, the operation of the described dispenser 10 is materially affected by the overall force required to overcome the spring force exerted by spring 82 or other stored energy mechanism.

In imparting the resistive force on the feed roll 14, the spring 82 operates by producing a gradually increasing tensile force on the residual segments defined by the uncut web portions, which force is directed oppositely to the force applied by the grasp of the user and increases gradually to a level capable of exceeding the strength of the web segment whereupon the segment is caused to break. Upon completion of this action, the now completely severed sheet of web material is retained by the user and the free end WE of the succeeding length of web material returns to the desired position for grasping by a subsequent user.

A spring selected for use as a stored energy mechanism, for example, spring 82 in the described dispenser will include among its characteristics the capability of being extendable to the dead center position of the crank 84 by the user's pulling the web W to rotate the feed roll 30 and thus the crank 84 against the force of the spring. Thus, the spring must not be so strong as to cause an uncut web to tear when pulled to load the spring. On the other hand, the spring will contain sufficient stored energy when in its fully-extended condition and with the crank in its dead center position to drivingly rotate the feed roll 14 for conducting the web carried thereby out of the discharge opening 50. Moreover, with the spring in its exhausted condition the line of cut, prior to severance of the sheet, or the web end WE, after severance, will be disposed in the position to permit ready grasping of the web end by a subsequent user. Lastly, the selected spring will be possessed of sufficient strength that, prior to achieving its fully extended condition, will exert a force sufficient to exceed the strength of the residual uncut web segment such that the segment will break when a pull tending to load the spring is imposed on the web, such breaking force being achieved before the feed roll 14 and crank 84 are rotated to the dead center condition of the latter.

It will be appreciated that the maximum force exerted by spring 82 will be substantially constant. As set forth above, the manufacturer would use an appropriate web such that when the user pulls the web end WE with sufficient force to rotate the feed roll 14, the web discharges adequately to place the free end WE of the succeeding length of web W at the predetermined position for grasping by a subsequent user. However, if the dispenser owner wishes to use a web having less tensile strength that that recommended by the manufacturer for a particular dispenser, for the same spring 82, the web with less tensile strength will break prematurely so that the subsequent user will not have a free end to grasp. According to the invention, the dispenser owner could then adjust the gap 42 between blades 40, 41 so that a larger unsevered piece of web would result. This larger unsevered piece would require a greater force to tear. This greater force would be sufficient to overcome spring force from spring 82 with the web with less tensile strength. The dispenser owner would thus be able to use the same dispenser for plural different tensile strength webs.

It will also be appreciated that by decreasing the gap 46 between blades 40, 41, webs of larger tensile strength could also be used. It will also be appreciated that a non-mechanical feed such as an electrical feed dispenser would work equally well with an adjustable cutter, such that the force required to rotate the drum could be the manual force of a user pulling on the web or electro/electro-mechanical force used to rotate the drum.

From the foregoing detailed description, it will be evident that changes, adaptations and modifications of the present invention can be made by those persons having ordinary skill in the art to which the aforementioned invention pertains. However, it is intended that all such variations not departing from the spirit of the invention, as recited in the claims, be considered as being within the scope thereof as limited solely by the appended claims.

I claim:

1. A device for dispensing and cutting a roll of web material, comprising:

a housing having a dispensing opening;

a roll carrier within said housing rotatably carrying a roll of web material to be dispensed;

a hollow rotatable cutting drum having a longitudinal slot on an external periphery thereof, said web material being wound part way around said cutting drum;

plural cutting blades within said drum and slidable within said slot; and a mechanism structured and arranged to move said plural cutting blades into and out of said slot as said cutting drum rotates; and an adjustment mechanism that manually adjusts a distance between at least two of said plural cutting blades in a longitudinal direction of said slot to adjust a size of a tail remaining on a next sheet of web material to be dispensed through said dispensing opening, wherein said adjustment mechanism is a moveable cutting blade that is connected to one of first and second stationary cutting blades.

2. The device as claimed in claim 1, further comprising a guide roller between said cutting drum and said dispensing opening to guide the material to be dispensed toward said dispensing opening.

3. The device as claimed in claim 2, the guide roller and the cutting drum are rotationally connected to each other so that said guide roller and said cutting drum rotate simultaneously.

4. The device as claimed in claim 1, further comprising a rotational operating member to manually drive said cutting drum.

5. The device as claimed in claim 1, further comprising at least one elastic member connected to said roll carrier to urge said roll of web material against said drum.

6. The device as claimed in claim 1, wherein said first and second cutting blades are on one and a same blade holder.

7. A device of the type for the simultaneous dispensing and cutting of bands of wound materials, having at least one roll of material which is mounted so that it can rotate freely on a support and is applied with pressure directly onto a drum with a non-slip surface so that a sheet of predetermined length is automatically dispensed and cut by simple manual tension on the band of material extending from the device, the cutting is performed by a cutting device associated with the drum and which extends outside of the drum during a cutting operation which is activated by putting the drum in rotation by pulling on the material, during the cutting operation the cutting device penetrates into the material stretched across the drum on both sides of the cutting device, whereby the cutting device is structured so that an unsevered portion of the material remains, when the cutting device returns into the drum after the cut, and then the drum is rotated back to its initial position so that upon breaking of the unsevered portion by pulling on the material by a user, a new band of material extends from the device, wherein the improvement comprises:

a cutting device having plural blades, at least one of said plural blades being manually adjustable with respect to a longitudinal direction of the drum, wherein the cutting device comprises three blades, two of said three blades being stationary and a third blade being movable between said two stationary blades.

8. The device as claimed in claim 7, wherein the cutting device is connected to a cam such that as the cam rotates, the cutting device moves from a first position within the drum to a second position outside the drum.

* * * * *